US006137212A

United States Patent [19]

Liu et al.

[11] Patent Number: 6,137,212

[45] Date of Patent: Oct. 24, 2000

[54] FIELD EMISSION FLAT PANEL DISPLAY WITH IMPROVED SPACER ARCHITECTURE

[75] Inventors: Jiang Liu, Olney; David Morton, Columbia, both of Md.; Philip Krzyzkowski, Red Bank; M. Robert Miller, Neptune, both of N.J.

[73] Assignee: The United States of America as represented by the Secretary of the Army, Washington, D.C.

[21] Appl. No.: 09/087,690

[22] Filed: May 26, 1998

[51] Int. Cl.[7] ..... H01J 1/46; H01J 1/02

[52] U.S. Cl. ..... 313/308; 313/309; 313/336; 313/351; 313/496

[58] Field of Search ..... 313/308, 309, 313/495, 496, 292, 336, 351, 497, 422

[56] References Cited

U.S. PATENT DOCUMENTS

| | | | |
|---|---|---|---|
| 3,500,102 | 3/1970 | Crost et al. | 313/109 |
| 3,755,704 | 8/1973 | Spindt et al. | 313/309 |
| 4,307,507 | 12/1981 | Gray et al. | 29/580 |
| 4,908,539 | 3/1990 | Meyer et al. | 29/580 |
| 5,210,472 | 5/1993 | Casper et al. | 315/349 |
| 5,726,529 | 3/1998 | Dean et al. | 313/495 |
| 5,742,117 | 4/1998 | Spindt et al. | 313/495 |
| 5,783,905 | 7/1998 | Greschner et al. | 313/497 |

*Primary Examiner*—Michael H. Day
*Assistant Examiner*—Joseph Williams
*Attorney, Agent, or Firm*—Paul S. Clohan, Jr.; Mark D. Kelly

[57] ABSTRACT

A method for forming a field emission flat panel display includes depositing a conductive patterned layer on a substrate, depositing an emitter material over the patterned layer, patterning the emitter material to provide a series of mask caps, etching the emitter material to provide arrays of emitter peaks with the mask caps thereon, depositing a dielective layer on the patterned layer and on the mask caps, depositing a conductive gate layer on the dielectric layer, depositing a high-resistivity dielectric layer on the gate layer, depositing a low-resistivity dielectric layer on the high-resistivity dielectric layer, and etching away portions of the dielectric layer, gate layer, high-resistivity dielectric layer and low-resistivity dielectric layer to expose the mask caps, and removing the mask caps to expose the emitter peaks to provide an emitter cathode panel, providing a transparent panel having a conductive coating thereon, and depositing a layer of thin film phosphors on the conductive coating to provide an anode screen, and attaching the anode screen to the cathode panel.

3 Claims, 3 Drawing Sheets

FIELD EMISSION FLAT PANEL DISPLAY WITH IMPROVED SPACER ARCHITECTURE

STATEMENT OF GOVERNMENT INTEREST

The invention described herein may be manufactured, used and licensed by or for the Government for Governmental purposes without the payment to us of any royalty thereon.

BACKGROUND OF THE INVENTION (1) Field of the Invention

The invention relates to electron beam devices and is directed more particularly to a method for forming a field emission flat panel and to the panel formed thereby.

(2) Description of the Prior Art

Field emission flat panels are known in the art. Such devices have been disclosed in prior patents, including U.S. Pat. No. 3,755,704, issued Aug. 28, 1973, to Charles A. Spindt et al; U.S. Pat. No. 4,307,507, issued Dec. 29, 1981, to Henry F. Gray et al; U.S. Pat. No. 4,908,539, issued Mar. 13, 1990, to Robert Meyer; and U.S. Pat. No. 5,210,472, issued May 11, 1993, to Stephen L. Casper et al. The devices have found wide acceptance in light-weight portable displays.

Conventional microfabricated field emission cathode arrays and powder phosphor anode screens have been widely used to manufacture the field emission flat panel displays. The cathode processing usually is carried out in accordance with the teachings of Spindt (U.S. Pat. No. 3,755,704) or Gray (U.S. Pat. No. 4,307,507). Parallel spaced conductors are first formed on a substrate and act as cathode columns (emitter base electrode) of the display. Sharp pointed emitters are formed on the cathode columns. Another set of parallel spaced conductors, known as gate rows, is separated by a dielectric layer and formed perpendicular to the cathode column. The gate rows are opened with apertures and cavities for each emitter. The device is operated by inputting voltage signals to the columns and rows through matrix-addressing. When the gate-to-emitter voltage differential at a particular intersection of a column and a row is sufficiently high, electron emission occurs at the emitter tip. The emitted electrons pass the gate and strike the phosphor screen anode which is closely mounted above the gate and biased with a higher potential. A display element is then lighted up as a result of the electron excitation of the phosphorous material.

A complex spacer manufacturing process is required in order to provide spacer means to support the anode screen and the cathode part inasmuch as the space therebetween is evacuated. The spacer architecture occupies a considerable display area, although efforts are made to confine the spacers between gate rows. It becomes a limitation factor for higher resolution displays. Further, over time the spacer becomes contaminated with emitter material. Accordingly, there is a need for a method for forming flat panel displays in which the usual spacer is not required, but in which the necessary support is provided, as well as electrical isolation of the gate means.

The anode screen typically is a conventional powder phosphor screen. However, the phosphor material decomposes under constant bombardment by high energy electrons. Particles released from phosphors are known to deposit on the emitter surface and cause tip contamination and even termination. Accordingly, there is a need for a method for forming flat panel displays in which the usual powder phosphor screen is not utilized, but wherein a phosphor screen is provided for electron excitation.

SUMMARY OF THE INVENTION

An object of the invention is therefore to provide a method for forming field emission flat panel displays wherein the usual spacer is not used, but wherein support is provided for the display and wherein electrical isolation is afforded the gate means.

A further object of the invention is to provide a method for forming field emission flat panel displays wherein the usual powder phosphor screen is not utilized, but a phosphor screen is provided for electronic excitation.

A further object of the invention is to provide a field emission flat panel display having layers of dielectric materials extending in columnar fashion beyond the emitter and towards the anode, and abutting the anode, to provide structural stability between the cathode and anode and to electrically isolate a gate means of the cathode from the anode.

A still further object of the invention is to provide a field emission flat panel display having as a portion of the anode which is facing the cathode, a thin film phosphor layer fixed to a transparent panel, the layer being adapted for excitation upon receipt of electrons from the emitter of the cathode.

With the above and other objects in view, as will hereinafter appear, a feature of the present invention is the provision of a method for forming a field emission flat panel display. The method includes the steps of providing a substrate having coplanar first and second major surfaces, depositing an electrically conductive and patterned layer on the first major surface of the substrate, depositing an electrically conductive layer of emitter material over the conductive and patterned layer, and photo-lithographically patterning an exposed surface of the layer of emitter material to provide a series of mask caps. The layer of emitter material is etched to provide arrays of emitter material peaks with the mask caps thereon, respectively. A dielectric layer is deposited on exposed portions of the electrically conductive and patterned layer to a height substantially equal to the height of the emitter material peaks, the dielectric layer being spaced from the emitter material peaks, and is deposited on the mask caps of a thickness substantially the same as the thickness of the dielective layer on the conductive and patterned layer. Further steps include depositing an electrically conductive gate layer on exposed surfaces of the dielectric layer covering the conductive and patterned layer, the gate layer being spaced from the mask caps, and on exposed surfaces of the dielectric layer covering the mask caps, depositing a high-resistivity dielectric layer on the gate layer, depositing a low-resistivity dielectric layer on the high-resistivity dielectric layer, and chemically etching away portions of the low-resistivity dielectric layer, portions of the gate layer, portions of the high-resistivity dielectric layer and portions of the low-resistivity dielectric layer to expose the mask caps. The mask caps then are removed to expose the emitter material peaks to provide an emitter cathode panel. Still further steps include providing a transparent panel having first and second co-planar major surfaces and having a transparent electrically conductive coating on the transparent panel first surface, depositing a layer of thin film phosphor on an exposed surface of the transparent coating to provide an anode screen, attaching the anode screen to the cathode panel with the anode screen first major surface facing the cathode panel first major surface, and out-gassing and sealing a space between the anode screen and the cathode panel, to provide the flat panel display.

In accordance with a further feature of the invention, there is provided a field emission flat panel display comprising an emitter cathode panel which includes a substrate having a planar major surface, an electrically conductive patterned layer disposed on the substrate planar surface, emitter material peaks upstanding over the conductive patterned layer, a dielective layer disposed on the conductive patterned layer and around the peaks, a gate layer disposed on the dielectric layer, a high-resistivity dielectric layer disposed on the gate layer, and a low-resistivity dielectric layer disposed on the high-resistivity dielectric layer. The panel display further comprises an anode screen which include a transparent panel having a planar major surface, a transparent electrically conductive coating on the panel planar surface, and a layer of thin film phosphor disposed on the transparent coating, the emitter cathode being sealed to the anode screen with an area therebetween being evacuated.

The above and other features of the invention, including various novel details of construction and combinations of parts, will now be more particularly described with reference to the accompanying drawings and pointed out in the claims. It will be understood that the particular method and device embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
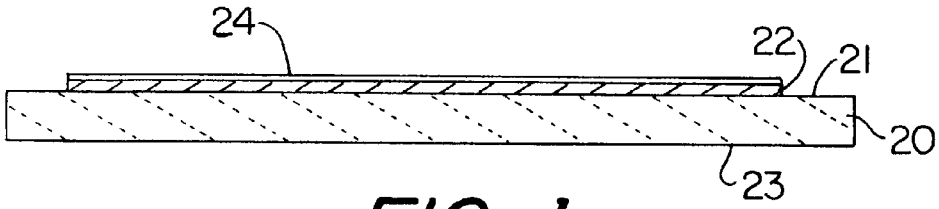
FIG. 1 is a sectional diagrammatic view illustrating first steps in forming a flat panel display.

Referring to FIG. 1, it will be seen that the method presented herein starts with the provision of a rigid substate 20 which may be of any material capable of supporting the display structure. The materials usually deemed most appropriate include glass, ceramic materials, sapphire and quartz. The material of the substrate 20 must be sealing compatible with the anode, which is discussed hereinunder. The substate 20 is provided with coplanar first and second major surfaces 21, 23.

An electrically conductive, or semiconductive, layer 22 is deposited and patterned on the first surface 21 of the substrate 20. The layer 22 preferably is a selected one of nickel (Ni), chromium (Cr), aluminum (Al), and titanium dioxide ($TiO_2$). If desired, a current-limiting resistive layer 24 may be deposited on the layer 22.

Figure 2:
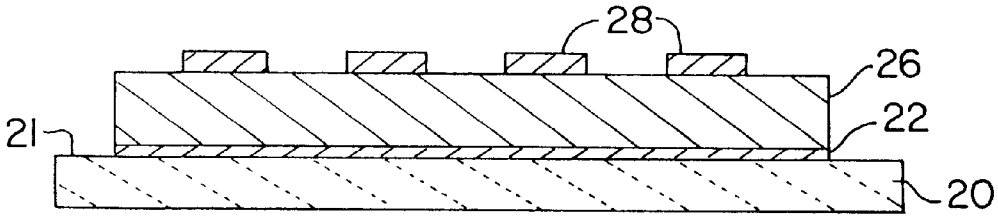
FIGS. 2–8 are each similar to FIG. 1, but illustrate a series of steps in forming the flat panel display.
Figure 3:
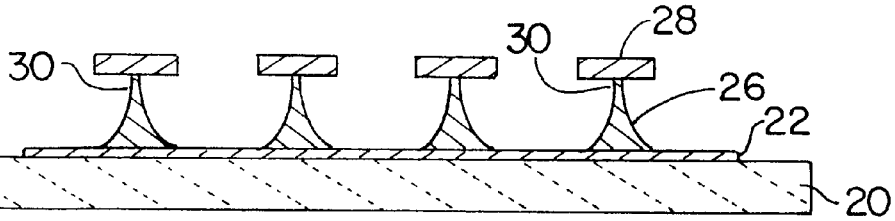

As is illustrated in FIG. 2, a layer 26 of a conductive or semiconductive emitter material is deposited over the patterned conductive layer 22 and is photo-lithographically patterned to produce mask caps 28. The emitter material, if conductive, preferably is a metal oxide. If semi-conductive, the emitter material preferably is silicon (Si). Dry or wet chemical etching of the emitter material 26 is undertaken to produce arrays of emitter material peaks 30, each of the peaks 30 having one of the mask caps 28 thereon (FIG. 3). The emitter material peaks 30 are of about one micron diameter at their bases.

Figure 4:
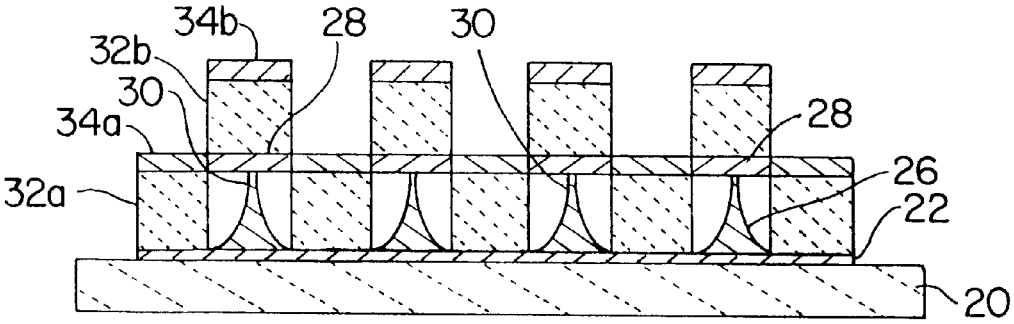

Referring to FIG. 4, it will be seen that there is then applied a first dielectric layer 32*a*, 32*b* on exposed portions of the electrically conductive and patterned layer 22, and on the mask caps 28. The dielectric layer 32*a*, 32*b* preferably is of aluminum oxide ($Al_xO_y$) or silicon oxide ($S_iO_x$) or silicon nitride ($Si_3N_4$), and is about ½ to 2 microns thick. The layer portion 32*a* is applied to a thickness sufficient to bring the height of the layer portion 32*a* to about the height of the peaks 30, and the layer portion 32*b* is applied to a thickness about equal to the thickness of the layer portion 32*a*.

As is shown in FIG. 4, an electrically conductive gate layer 34*a*, 34*b* is deposited on the dielectric layer portions 32*a*, 32*b*. The gate layer 34*a*, 34*b* preferably is of metal, such as nickel (Ni), or chromium (Cr), or platinum (Pt), or aluminum (Al), and is of a thickness of about ½ to 1 micron. The gate layer portions 34*a*, 34*b* are of about the same thickness.

Figure 5:
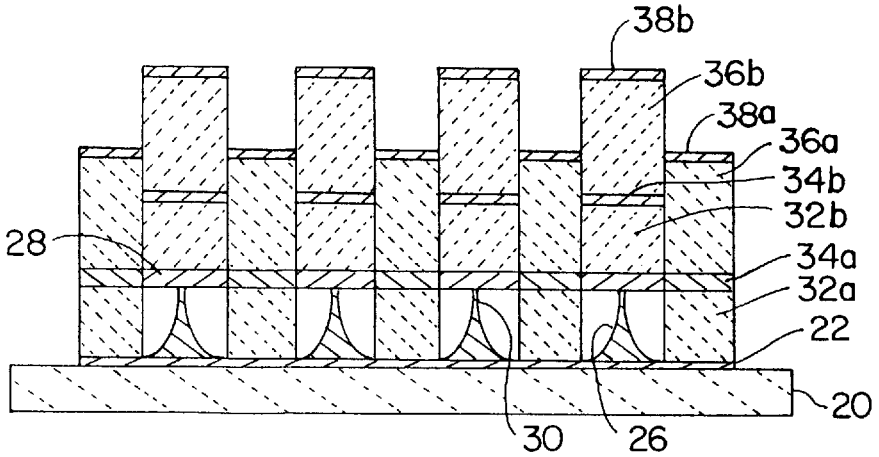

A high-resistivity dielectric layer 36*a*, 36*b* is deposited on the gate layer 34*a*, 34*b* (FIG. 5). The layer 36*a*, 36*b* preferably is of silicon oxide ($S_iO_x$) or silicon nitride ($Si_3N_4$) A low-resistivity dielectric layer 38*a*, 38*b* is deposited on the high resistivity dielectric layer 36*a*, 36*b*. The layer 38*a*, 38*b* preferably is of a conductive material such as titanium dioxide ($TiO_2$) or a mixture of nickel (Ni), chromium (Cr) and platinum (Pt).

Figure 6:
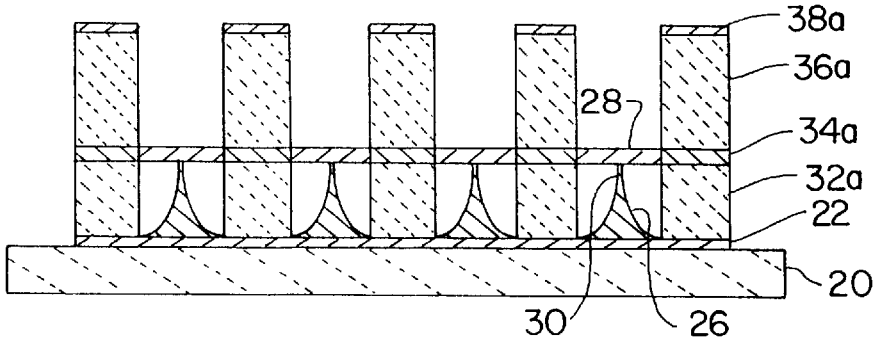
Figure 7:
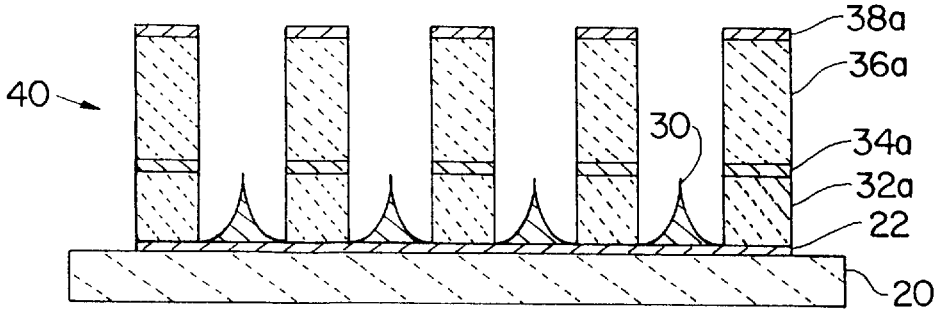

The low resistivity dielectric layer portions 38*b* are removed by etching, the high-resistivity dielectric layer portion 36*b*, the gate layer portion 34*b*, and the dielectric layer portion 32*b*, leaving the mask caps 28 exposed (FIG. 6). The mask caps 28 are then removed (FIG. 7), as by oxidation and chemical etching, to provide a cathode panel 40 portion of the display. The etching may be done by any of several known processes such as wet chemical etching, plasma etching, reactive ion etching, or other similar method for removing such materials from a wafer surface.

Figure 8:
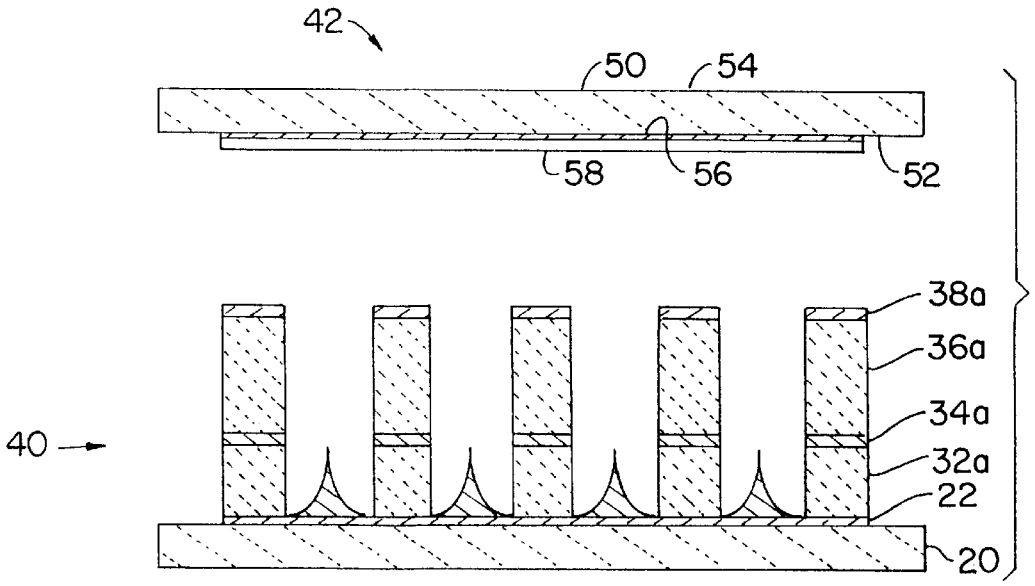

Referring to FIG. 8, it will be seen that an anode screen 42 is formed by providing a transparent panel 50, having first and second co-planer major surfaces 52, 54. The panel 50 may be of glass or quartz, or the like, and is provided with a transparent electrically conductive coating 56, such as indium tin oxide or titanium dioxide, on the first surface 52. A thin film phosphor coating 58 is then applied to the conductive coating 56, as by molecular beam epitaxy or chemical vapor deposition. The anode screen 42 is then patterned according to color layout and aligned with the cathode panel 40 (FIG. 8).

Figure 9:
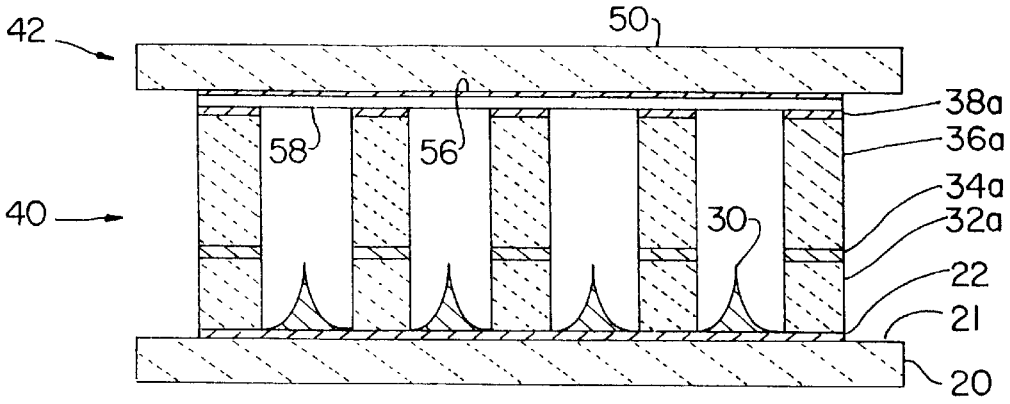
FIG. 9 is similar to FIGS. 1–8, but illustrates a final step in the forming of the flat panel display, and further illustrates one form of flat panel display illustrative of an embodiment of the invention.

The anode screen 42 and the cathode panel 40 are then abutted (FIG. 9), out-gassed and sealed.

The display thereby formed (FIG. 9) accordingly includes the emitter cathode panel 40 including the substrate 20 having the planar major surface 21, the electrically conductive patterned layer 22 disposed over the substrate planar surface 21, and emitter peaks 30 upstanding over the conductive patterned layer 22. The dielectric layer portion 32a is disposed on the conductive patterned layer 22 and around the peaks 30, and the gate layer portion 34*a* is disposed on the dielective layer portion 32*a*. The high-resistivity layer portion 36*a* is disposed on the gate layer portion 34*a* and the low-resistivity layer portion 38*a* is disposed on the high-resistivity layer portion 36*a*.

The display further includes the anode screen 42 having the transparent panel 50, the transparent conductive coating 56 on the panel 50, and the thin film phosphor coating 58 on the transparent conductive coating 56.

The display still further includes the anode screen 42 and cathode emitter panel 40 sealingly joined together and evacuated.

There is thus provided a method for forming a field emission flat panel display in which there is formed above the gate layer (34*a*, high resistively dielectic structure (36*a*) with a conductive cap (38*a*) on top of each column, which column serves as the electrical isolation between gate and anode, as a medium for electric charge dissipation, and as the support for the whole display panel, alleviating the need for spacers, or the like. There is further provided a highly efficient thin film phosphor anode screen which minimizes the possibility of contamination of the emitter tips.

It is to be understood that the present invention is by no means limited to the particular construction and method steps herein disclosed and/or shown in the drawings, but also comprises any modifications or equivalents within the scope of the claims.

What is claimed is:

1. A field emission flat panel display comprising:

an emitter cathode panel comprising:

a substrate having a planar major surface;

an electrically conductive patterned layer disposed on said substrate planar surface;

emitter material peaks upstanding over said conductive patterned layer;

a dielective layer disposed on said conductive patterned layer and around said peaks;

a gate layer disposed on said dielectric layer;

a high-resistivity dielectric layer disposed on said gate layer; and a low-resistivity dielectric layer disposed on said high-resistivity dielectric layer;

an anode screen comprising:

a transparent panel having a planar major surface;

a transparent electrically conductive coating on said panel planar surface; and a layer of thin film phosphor disposed on said transparent coating;

said emitter cathode sealed to said anode screen with an area therebetween evacuated.

2. The flat panel display in accordance with claim 1 and further comprising a resistive layer disposed on said electrically conductive patterned layer.

3. The flat panel display in accordance with claim 1 wherein said transparent panel is of a material selected from a group of materials consisting of glass and quartz.

* * * * *